US005957189A

United States Patent [19]

Uzaki et al.

[11] Patent Number: 5,957,189

[45] Date of Patent: Sep. 28, 1999

[54] APPARATUS AND METHOD FOR SEQUENTIALLY FEEDING QUANTITIES OF SAND INTO A MOLD SPACE AND SUBJECTING THE SPACE TO EVACUATION AND THEN PRESSURE INCREASE AFTER EACH FEED

[75] Inventors: Nagato Uzaki, Toyohashi; Masayoshi Kasazaki; Hisashi Harada, both of Hoi-gun; Kazuo Sugimoto, Toyokawa, all of Japan

[73] Assignee: Sintokogio, Ltd., Japan

[21] Appl. No.: 08/707,875

[22] Filed: Sep. 9, 1996

[30] Foreign Application Priority Data

| | | | |
|---|---|---|---|
| Sep. 8, 1995 | [JP] | Japan | 7-257107 |
| Oct. 6, 1995 | [JP] | Japan | 7-286855 |
| Jan. 26, 1996 | [JP] | Japan | 8-032989 |

[51] Int. Cl.[6] ..... B22C 15/00; B22C 15/24

[52] U.S. Cl. ..... 164/7.1; 164/37; 164/38; 164/160.1; 164/193; 164/195

[58] Field of Search ..... 164/7.1, 37, 38, 164/160.1, 169, 192, 193, 195, 6, 12, 15

[56] References Cited

U.S. PATENT DOCUMENTS

| | | | |
|---|---|---|---|
| 5,558,148 | 9/1996 | Uzaki et al. | 164/7.1 |

FOREIGN PATENT DOCUMENTS

| | | | |
|---|---|---|---|
| 55-144359 | 11/1980 | Japan | 164/37 |
| 57-195559 | 12/1982 | Japan | 164/160.1 |
| 59-1049 | 1/1984 | Japan | 164/7.1 |
| 60-213336 | 10/1985 | Japan | 164/15 |
| 60-223638 | 11/1985 | Japan | 164/38 |
| 63-21582 | 5/1988 | Japan . | |
| 1533820 | 1/1990 | U.S.S.R. | 164/7.1 |
| WO82/03348 | 10/1982 | WIPO | 164/7.1 |

*Primary Examiner*—J. Reed Batten, Jr.
*Attorney, Agent, or Firm*—Limbach & Limbach L.L.P.

[57] ABSTRACT

A first quantity of all the molding sand necessary to produce a mold is fed in the mold space, the first quantity being one of at least two parts divided from the total molding sand. The mold space is evacuated and then air is introduced into the mold space at the air-pressure rising rate of 30—to 500 kg/cm$^2$/sec. Another quantity of the molding sand is fed into the mold space, the mold space is evacuated and then air is introduced into the mold space at the air-pressure rising rate of 30—to 500 kg/cm$^2$/sec. The apparatus includes a sand passage through which each quantity of sand is fed into the mold space, and a gate for closing the sand passage thereby closing the mold space to allow the mold space to be evacuated and then subjected to a pressure increase.

10 Claims, 5 Drawing Sheets

APPARATUS AND METHOD FOR SEQUENTIALLY FEEDING QUANTITIES OF SAND INTO A MOLD SPACE AND SUBJECTING THE SPACE TO EVACUATION AND THEN PRESSURE INCREASE AFTER EACH FEED

FIELD OF THE INVENTION

This invention relates to an apparatus and a method for producing a mold (including a core) by means of air pressure, in particular, for producing a mold in a mold space in a pattern box.

DESCRIPTION OF THE PRIOR ART

Conventionally, a method to introduce molding sand via a valve at one time into a mold space in an evacuated pattern box is well known (for example, see Japanese Patent (B) 63-21582). However, in this method, since air and molding sand enter the mold space at the same time, the air reaches many parts of the mold space before the molding sand. Thus the air tends to prevent the molding sand from entering these parts.

Further, the molding sand that flows into the mold space tends to go straight due to its inertia. Accordingly, any parts of the mold space that extend in different directions from the flow of the molding sand are not filled with it. Especially, narrow or upwardly-extending parts tend not to be filled. To eliminate this phenomenon, vent plugs are provided in such parts to create a vacuum in them. However, to determine the best positions for vent plugs is very difficult, and a pattern box provided with vent plugs has a high cost and takes a lot of work.

This invention is conceived to resolve these disadvantages. Its purpose is to provide a molding method and an apparatus that can fill the narrow or upwardly-extending parts of a mold space, and that can fill a complicated mold space.

SUMMARY OF THE INVENTION

This invention is based on a discovery that if molding sand is charged part by part (aliquots) into a mold space of a pattern box, and each part is subject to air pressure, the pattern box is sufficiently filled with the molding sand. The air may be pressurized air, or ambient air that flows into a mold space wherein there is a vacuum.

In one of the methods of the present invention, a predetermined amount of molding sand that fills the mold space of a pattern box is divided into two parts. A first part of the molding sand is charged into the mold space. Then an air flow at a set speed is introduced into the mold space. Then the second part of the molding sand is charged into the mold space, and an air flow at a set speed is again introduced into the mold space.

The present invention also provides a molding apparatus to carry out this method.

Other structures, advantages, and features of the present invention will be apparent from the description below.

DESCRIPTION OF THE PREFERRED EMBODIMENTS

Figure 1:
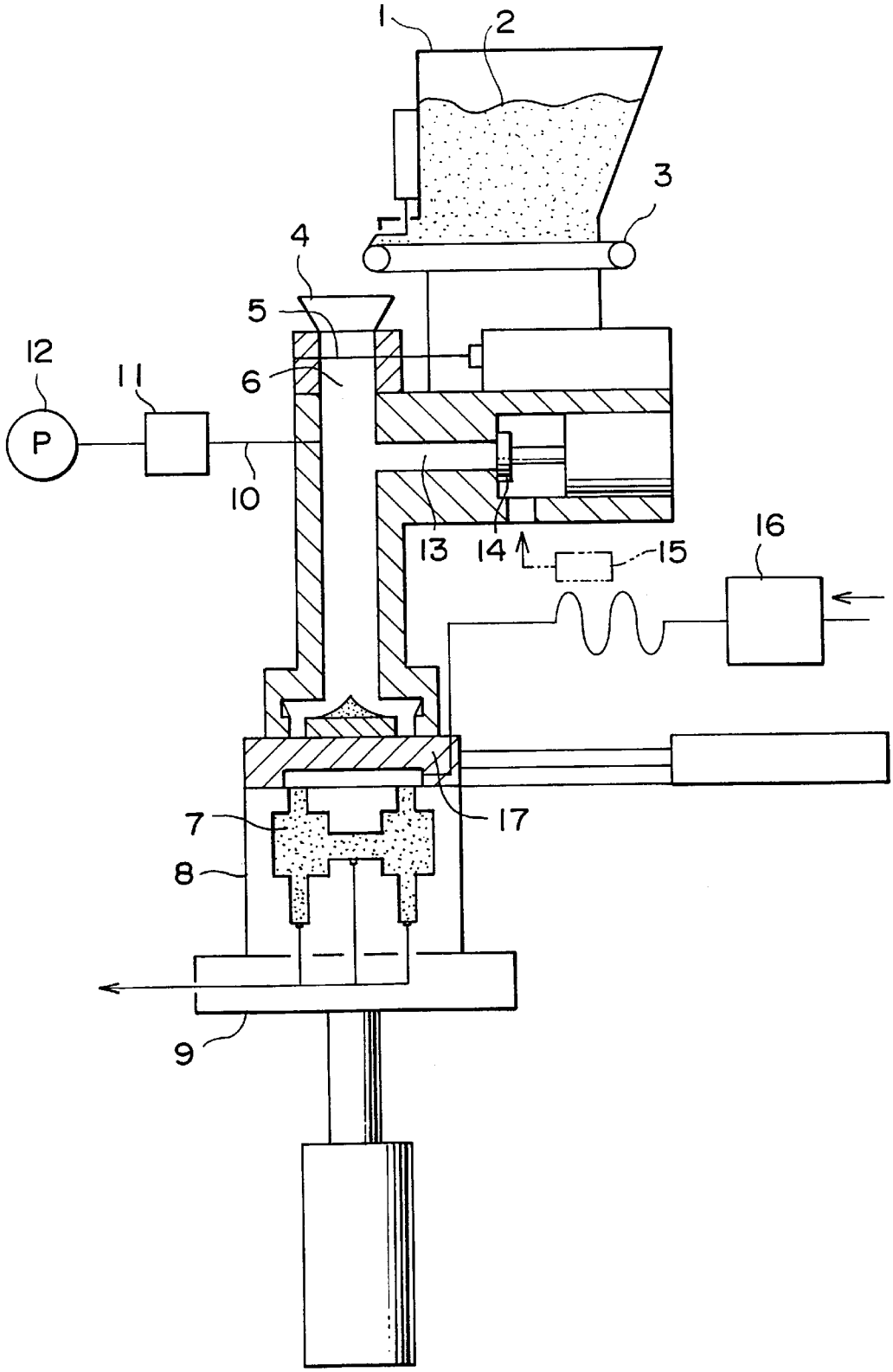
FIG. 1 is a cross-sectional view of a first embodiment of the molding apparatus of the present invention.

The preferred embodiments will now be explained in detail by reference to the accompanying drawings. FIG. 1 shows a first embodiment of a molding apparatus of the present invention. An upper hopper 1 has a belt feeder 3 that acts as means to meter and feed molding sand 2. By setting the operating time of the belt feeder 3 a first feeding amount and a second feeding amount of the molding sand are preset.

A port 4, which receives the molding sand 2, is disposed under an end of the belt feeder 3. This port 4 communicates with a feeding pipe 6. The pipe 6 is connected to a pattern box 8 so that the pipe communicates with the mold space 7 of the pattern box 8. The port 4 has a gate 5, which closes the pipe 6. The pattern box 8 is placed on a table 9, which moves vertically.

An air-suction pipe 10 is connected to the feeding pipe 6. A vacuum pump 12 is connected to the air-suction pipe 10 through an air-suction valve 11. An air-supply pipe 13 is also connected to the feeding pipe 6. The air-supply pipe 13 is connected to a compressed-air-supply tank 15 via an air-introducing valve 14.

In operation, by setting the operating time of the belt feeder 3, all the molding sand 2 that is necessary to produce a mold is divided into at least two parts, to preset the first and second feeding amounts of the molding sand. For a small mold, the molding sand may be divided into two to three parts, and for a large one, it may be divided into three to ten parts. Further, for a complicated mold, the number of the divided parts of the molding sand is increased in comparison with the number for a simple one.

Then the gate 5 is opened, and the fist amount of the molding sand metered by the belt feeder 3 drops through the port 4 into the mold space 7. The air-introducing valve 14 is closed when the molding sand is fed. The gate 5 is then closed. Under these conditions the assembly of the pipe 6 and pattern box 8 is sealingly closed. Then, the air-suction valve 11 is opened, and a vacuum in the mold space 7 is created by the vacuum pump 12. When the air pressure of the mold space 7 reaches a vacuum between 2 to 100 torr, the air-suction valve 11 is closed. Then the air-introducing valve 14 is opened so that a first compressed-air flow is introduced from the tank 15 at a pressure-rising rate of 30 to 600 $kg/cm^2/sec$. Preferably, two or three compressed air flows are introduced into the mold space 7. Thus the molding sand in the mold space is subjected to the air flow or flows. Then the gate 5 is again opened.

The second amount of the molding sand is fed into the mold space by the belt feeder 3, and the gate 5 is closed. Then the air in the pattern box 8 is removed by the pump 12, and in the same way a compressed-air flow or flows are introduced into the mold space 7. These steps are repeated until the final amount of the divided molding sand is fed into the mold space. Thus the space is filled with molding sand, and the mold or core is produced. After this, the table 9 is lowered, and the mold is taken out.

As a modified embodiment, the compressed-air tank 15 may be eliminated, and ambient air flows may be introduced into the mold space instead of compressed-air flows.

In the first embodiment, self-curing molding sand is used. However, instead of it gas-cured molding sand may be used.

If so, a gas generator 16 is connected to tie pattern box 8 so that curing gas communicates with the mold space. The curing gas is introduced into the mold space through a plate 17 after the final air flow is introduced into the mold space.

Although in the first embodiment a vacuum is created in the mold space 7 before the second amount of the molding sand is fed, this vacuum may not be necessary, and some air flows may be introduced into the mold space after the air-introducing valve 14 is opened.

In this invention the pressure-rising rate of air flows is preferably 30 to 600 kg/cm$^2$/sec, and a rate of 100 to 400 kg/cm$^2$/sec is more preferable. If the rate is more than 400 kg/cm$^2$/sec, the air-introducing valve must be large, and thus it is not economical.

The range of the vacuum of the mold space is preferably between 2 to 100 torr, and within this range the highest vacuum is more preferable.

When the compressed-air flows are introduced into the mold space, the pressure of the compressed air is preferably 2 to 9 kg/cm$^2$, and a range of 4 to 9 kg/cm$^2$ is more preferable. Within his range the highest vacuum is best if air of such pressure is available.

Figure 2:
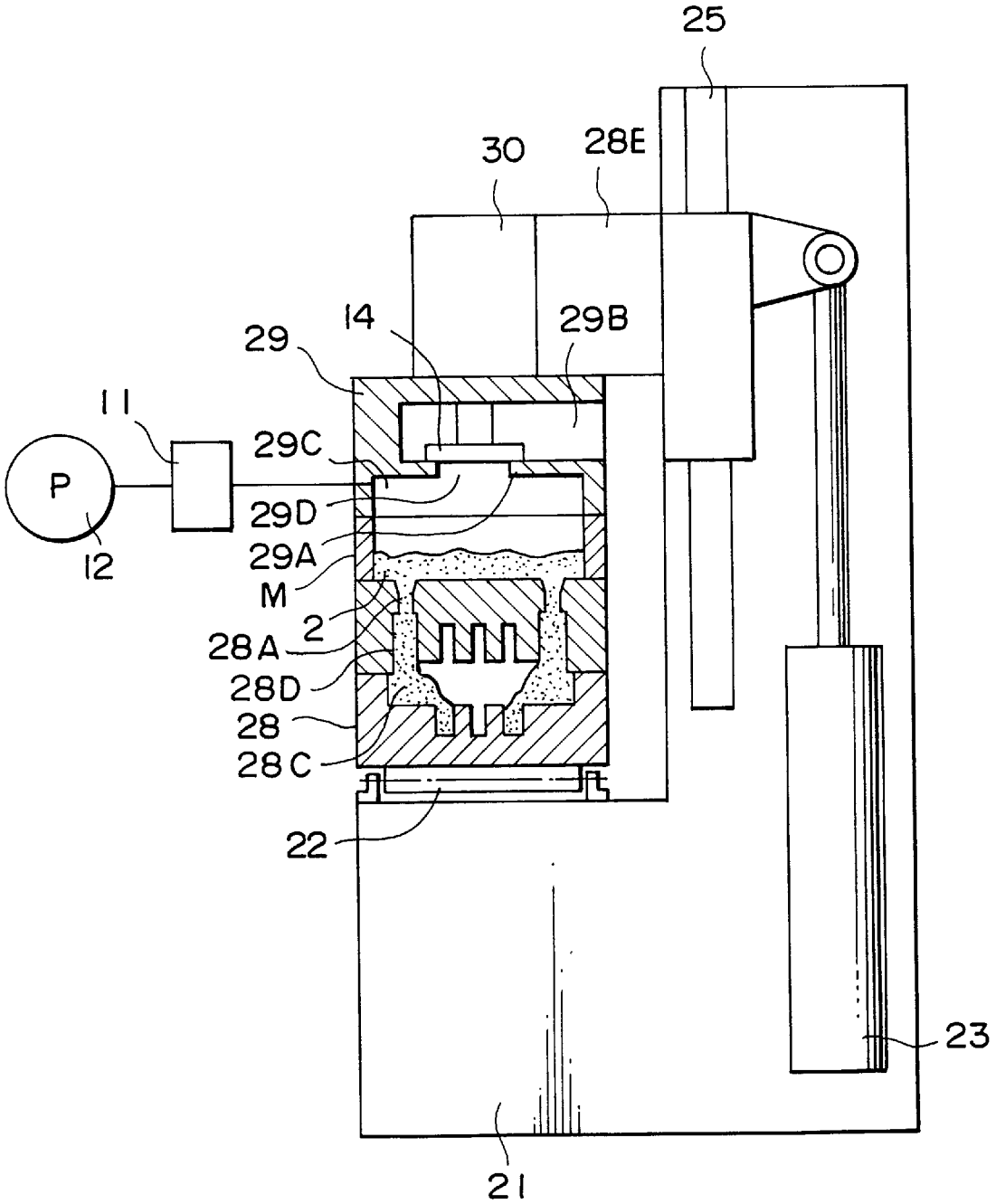
FIG. 2 is a cross-sectional view of a second embodiment of the molding apparatus of the present invention.

FIG. 2 shows a second embodiment of the molding apparatus of the present invention. The apparatus has a column 21. A roller conveyor 22 is mounted on a horizontally-extending part of the column 21. A pattern box 28, which has a plurality of molding-sand-feeding mouths, is transferred by the conveyor 22. A cover 29 is mounted on an arm 28E, which is in turn slidably mounted on a vertical guide bar 25 secured to the vertically-extending put of the column 21. The arm 28E is vertically moved along the guide bar by an actuator 23 so that the cover 29 is pressed against a filling frame M attached to the top of the pattern box 28. The cover 29 has an intermediate floor 29A, which has a central opening 29D. A cylinder 30 is mounted on the arm 28E. The cylinder 30 has an air-introducing valve 14. This valve covers the central opening to close a space 29C defined by the cover 29, filling frame M, and pattern box 28. An air passage 29B, which communicates with ambient air, is formed in the cover such that the space 29C communicates with ambient air when the valve 14 is opened. Pattern box 28 defines a molding space including upright space 28A, horizontal space 28C, and vertical space 28D between upright space 28A and horizontal space 28C.

The operation of the molding apparatus is now explained. In this operation gas-cured molding sand 2 is introduced into the pattern box 28 and cured. A minimum number of vent holes and vent plugs are provided in the pattern box.

Figure 3:
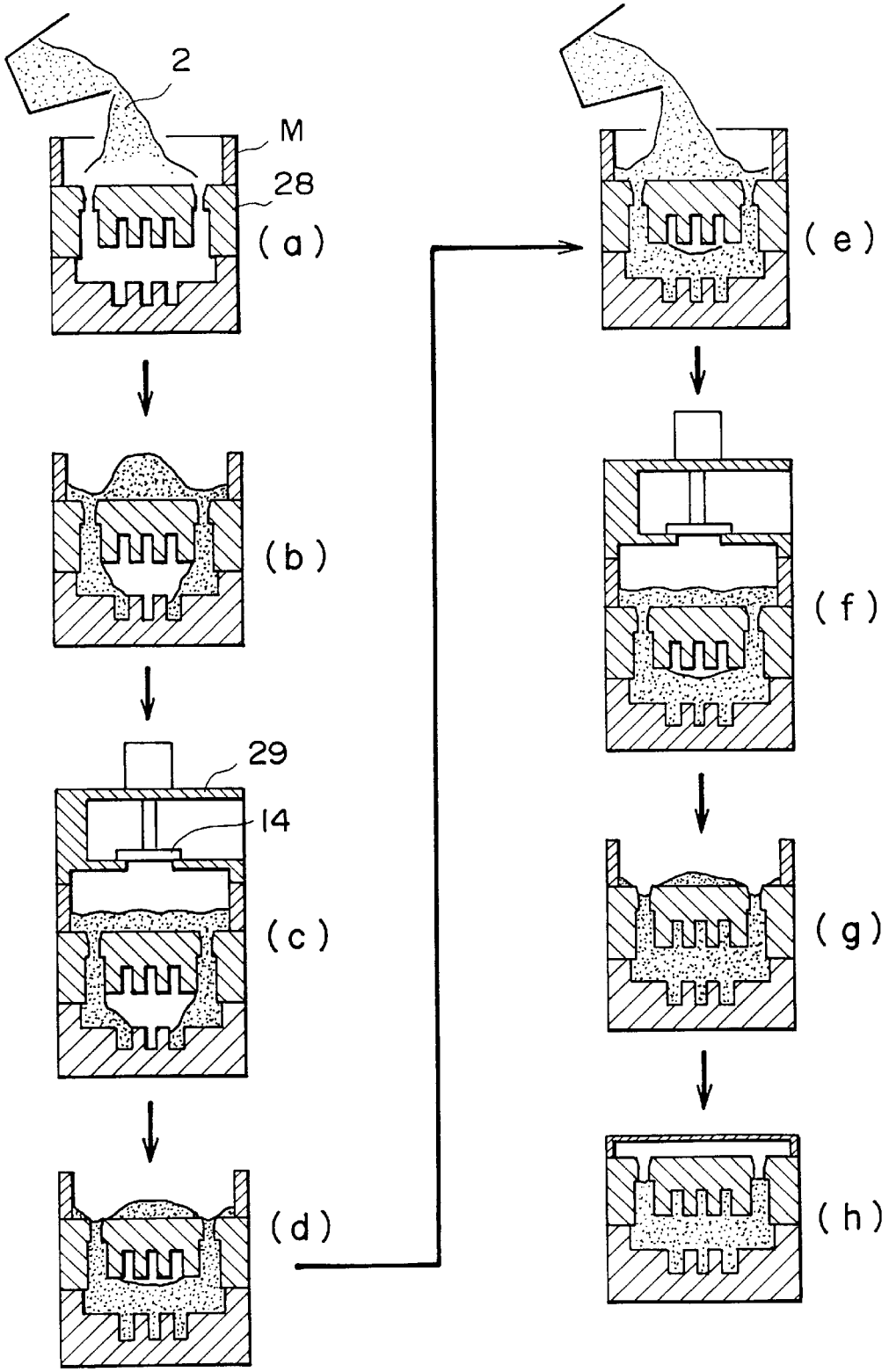
FIGS. 3(*a*)–3(*h*) show the method of the invention carried out by the apparatus of FIG. 2.

As in FIG. 3(*a*), the filling frame M is placed on the halves of the pattern box, and as in FIG. 3(*b*) a part of the molding sand is fed into the filling frame. The molding sand fed into the box is leveled, and then as in FIG. 3(*c*) the space is closed by the cover.

Then the valve 11 is opened to create a vacuum in the closed space of 2 to 100 torr. The valve 11 is then closed, while the valve 14 is opened so that the ambient air flow enters the passage 29B, opening 29D, and space 29C at the air-pressure rising rate of 50 to 600 kg/cm$^2$/sec (preferably, at the rate of 200 to 400 kg/cm$^2$/sec). Accordingly, an amount of molding sand is introduced into the mold space in the pattern box 28 as in FIG. 3(*d*). These steps are repeated at least twice, and the results are shown in FIGS. 3(*e*)–(*h*).

After this, the pattern box and filling frame are moved to a gas-curing station (not shown), and the molding sand in them is gas-cured there.

Figure 4:
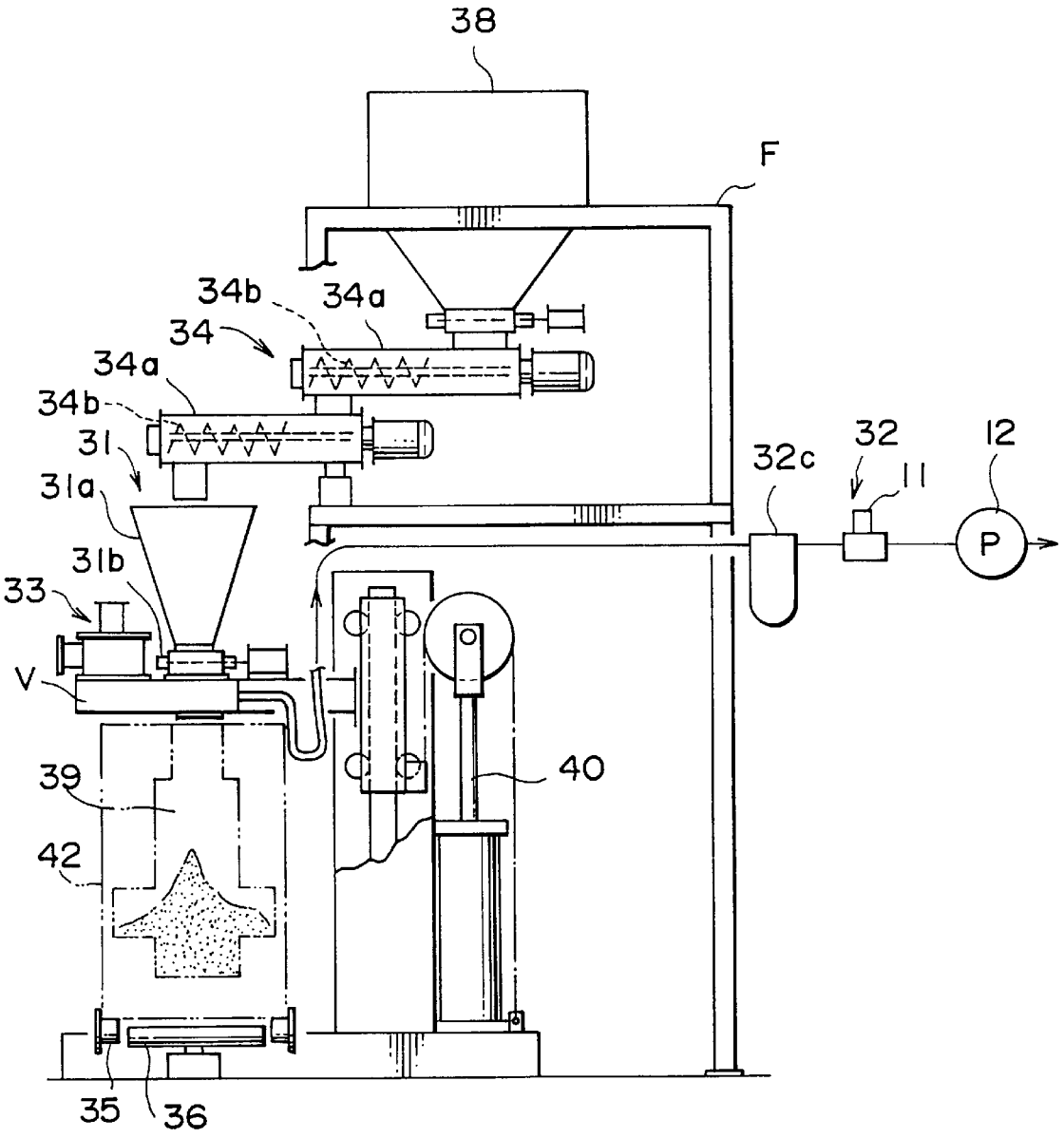
FIG. 4 is a cross-sectional front view of a third embodiment of the molding apparatus of the present invention.
Figure 5:
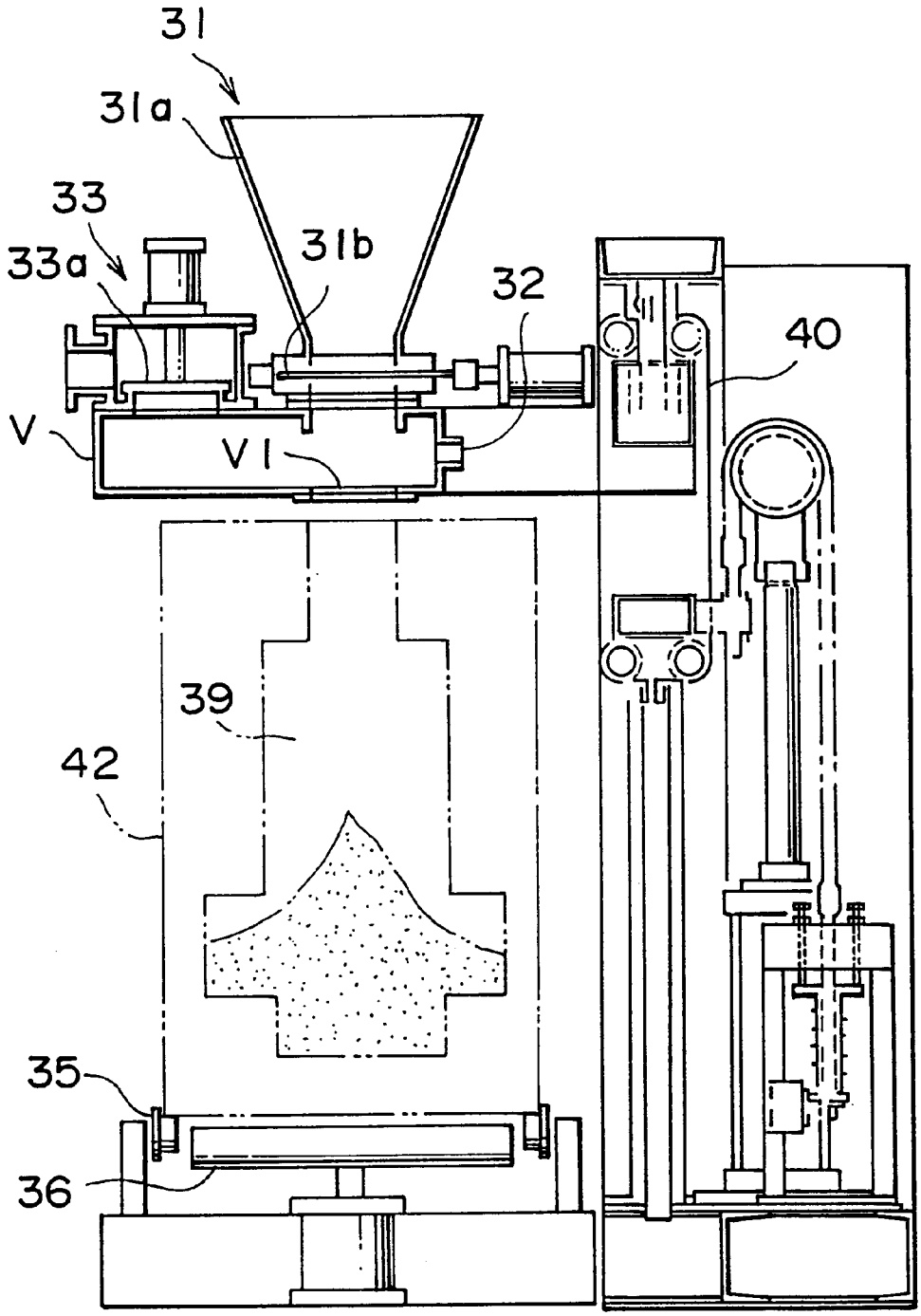
FIG. 5 is a cross-sectional side view of the apparatus of FIG. 4.

FIGS. 4 and 5 show a third embodiment of the molding apparatus of the present invention. The apparatus includes a frame F on which are mounted, from top to bottom, a sand-container 38, mixer assembly 34, molding-sand feeder means 31, pressure-reducing means 32, ambient-air-introducing means 33, and pattern-box-transfer means 35.

The mixer assembly 34, which is disposed under the sand-container 38, includes upper and lower mixers 34*a*, 34*a* and a binder-supplying device (not shown). The vane 34*b* of each mixer rotates, mixes, and advances the sand.

A sand-feeding hopper 31*a* is disposed under the output end of the lower mixer 34*a*. The hopper 31*a* and a sand-introducing gate 31*b* disposed under the hopper constitute a sand-feeding means 31. When the gate 31*b* is opened, a predetermined amount of mixed molding sand is fed into a mold space 39 in a pattern box 42.

The pressure-reducing means 32, which includes a hollow container V has a port V1 which, is disposed under the sand-feeding means 31. At one end the hollow container V communicates with the opening of the pattern box 42. At the other end it communicates with a vacuum pump 12 through an air-suction valve 11 and a filter 32*c*. A vacuum is created in the mold space 39 to a range between 2 to 100 torr.

Further, air-introducing means 33 is integrally mounted on the hollow container V. This means has an air-introducing valve 33*a* through which ambient air is introduced into the mold space 39 (see FIG. 4).

The pattern box 42 is horizontally transferred by a conveyor 35, and is raised to a predetermined level by a cylinder 36. The hollow container is lowered and sealingly its port V1 is pressed against the opening of the pattern box 42 by an actuator 40 mounted on the frame F.

In operation, the molding sand fed onto mixers is supplied with a binder from a binder-supply device (not shown). As in the first embodiment, since the time to operate and stop the mixers is preset an amount of mixed molding sand to be discharged is preset.

Creating a vacuum in the mold space 39 and introducing into it ambient-air flows are done as in the first embodiment.

What we claim is:

1. An apparatus that feeds molding sand into a mold space, wherein the mold space includes an upright space at an upper end of the mold space, the upright space provides an entrance to the mold space, and the mold space also includes a horizontal space extending transversely with respect to the upright space, the apparatus comprising:

a pattern box defining the mold space, the pattern box having an opening at the upper end of the mold space;

sand-feeding means having a molding sand passage disposed above the opening of the pattern box and configured to direct aliquots of the molding sand downward to the opening of the pattern box, and a gate positioned and configured to close the molding sand passage when desired, thereby closing the mold space, wherein the sand-feeding means is configured to feed the aliquots of the molding sand sequentially into the mold space, the total amount of the aliquots equaling a predetermined amount of the molding sand;

a vacuum assembly coupled to the opening of the pattern box, including a valve, and configured to evacuate the mold space in response to opening of the valve after each of the aliquots has been fed into the mold space and the gate has closed the molding sand passage; and an air introducing assembly having an air valve in fluid communication with the opening of the pattern box, wherein the air introducing assembly is configured to introduce air into the mold space when the air valve is opened at a time when the gate has closed the molding sand passage and the vacuum assembly has evacuated the mold space.

2. The apparatus of claim 1, further comprising a mixer assembly disposed above the sand-feeding means.

3. An apparatus for feeding molding sand into a mold space defined by a pattern box, the pattern box being located in a predetermined position and having an opening at an upper end of the mold space, said mold space including an upright space below the opening, said upright space providing an entrance to the mold space, and said mold space also including a horizontal space extending transversely with respect to the upright space, the apparatus comprising:

sand-feeding means having an element defining a molding sand passage, said element being configured to be positioned above the opening of the pattern box so as to direct aliquots of the molding sand downward through the molding sand passage to the opening of the pattern box, the sand feeding means also including a gate positioned and configured to close the molding sand passage when desired thereby closing the mold space, wherein the sand-feeding means is configured to feed the aliquots of the molding sand sequentially into the mold space, the total amount of the aliquots equaling a predetermined amount of the molding sand;

a vacuum assembly configured to be coupled to the opening of the pattern box so as to evacuate the mold space after each of the aliquots has been fed into the mold space and the gate has closed the molding sand passage; and air introducing means configured to be positioned in fluid communication with the opening of the pattern box so as to introduce air into the mold space at a time when the vacuum assembly has evacuated the mold space.

4. The apparatus of claim 3, wherein the sand-feeding means includes a conveyor, the conveyor being operable for a predetermined time to feed each of the aliquots of the molding sand into the molding sand passage.

5. The apparatus of claim 4, wherein the conveyor includes a mixer configured to mix the molding sand.

6. An apparatus for producing a mold, comprising:

a pattern box defining a mold space and having an opening at an upper end of the mold space, the mold space including an upright space below the opening, said upright space providing an entrance to the mold space, and said mold space also including a horizontal space extending transversely with respect to the upright space;

an element defining a molding sand passage, said element being positioned above the opening of the pattern box in a position for directing molding sand downward through the molding sand passage to the opening of the pattern box, said element also including a gate positioned and configured to close the molding sand passage when desired thereby defining a closed space including the mold space;

sand-feeding means configured to provide aliquots of the molding sand to the element such that the aliquots of the molding sand fall through the molding sand passage to the opening of the pattern box, the total amount of the aliquots equaling a predetermined amount of the molding sand;

a vacuum assembly coupled to the opening of the pattern box and configured to evacuate the mold space after each of the aliquots has been fed into the mold space and the gate has closed the molding sand passage; and air introducing means positioned in fluid communication with the opening of the pattern box so as to introduce air into the mold space at a time when the vacuum assembly has evacuated the mold space.

7. The apparatus of claim 6, wherein the mold space also includes a vertical space between the horizontal space and the upright space, said vertical space extending upwardly from the horizontal space to the upright space.

8. A molding method, comprising the steps of:

(a) placing a filling frame on a pattern box that has a plurality of sand-feeding mouths in an upper surface thereof, said pattern box defining a mold space, wherein the mold space includes an upright space at an upper end of the mold space, the upright space communicates with the sand-feeding mouths and provides an entrance to the mold space, and the mold space also includes a horizontal space extending transversely with respect to the upright space;

(b) feeding, through the filling frame and the upper end of the mold space into said mold space, one subset of a quantity of molding sand, said quantity of molding sand being sufficient to fill the mold space;

(c) sealingly closing the filling frame to prevent flow of additional molding sand through the filling frame into the mold space, thereby establishing a closed space containing said subset of the quantity of molding sand;

(d) reducing the air pressure in the closed space to a pressure in the range from 2 to 100 torr;

(e) after step (d), causing the filling frame to communicate with ambient air such that the ambient air is introduced into the closed space to cause the pressure in said closed space to rise at a rate in the range from 50 to 600 $kg/cm^2/sec$; and (f) repeating steps (b), (c), (d), and (e) at least twice, wherein a different subset of the quantity of molding sand is fed into the mold space during each repetition of step (b).

9. A method for filling a mold space with molding sand, comprising the steps of:

(a) positioning a pattern box which defines the mold space, the mold space including an upright space at an upper end of the mold space, said upright space providing an entrance to the mold space, the mold space also including a horizontal space extending transversely with respect to the upright space;

(b) connecting a passage means to the pattern box, the passage means defining a sand passage and including a gate for closing the sand passage;

(c) measuring an aliquot part of an amount of molding sand, said amount of molding sand equaling a filling amount that fills the mold space of the pattern box;

(d) feeding the aliquot part of the molding sand into the sand passage while the gate is open;

(e) closing the sand passage and the mold space by closing the gate, thereby defining a closed space;

(f) evacuating the closed space, thereby establishing an evacuated space;

(g) introducing air into the evacuated space at an air-pressure rising rate of 30—to 500 $kg/cm^2/sec$;

(h) repeating steps (c)–(g) for another aliquot part of said amount of molding sand, until the total amount of each said aliquot part in the mold space reaches the filling amount.

10. The method of claim 9, wherein steps (c) and (d) include metering each said aliquot part using a metering conveyor, thereby feeding each said aliquot part into the sand passage.

* * * * *